United States Patent [19]

Polan

[11] Patent Number: 4,926,946

[45] Date of Patent: May 22, 1990

[54] PENDENT STYLE SPRINKLER WITH COVER

[75] Inventor: George S. Polan, Harleysville, Pa.

[73] Assignee: Central Sprinkler Corporation, Landsale, Pa.

[21] Appl. No.: 268,911

[22] Filed: Nov. 8, 1988

[51] Int. Cl.[5] ..... A62C 37/08; A62C 37/10; A62C 33/00; A62C 39/00

[52] U.S. Cl. ..... 169/37; 169/51; 248/345; 239/288.5

[58] Field of Search ..... 169/37–41, 169/90, 51, 91; 239/200–206, 288–288.5; 248/345

[56] References Cited

U.S. PATENT DOCUMENTS

| | | | |
|---|---|---|---|
| 494,604 | 4/1893 | Slocum . | |
| 515,938 | 3/1894 | McLauthlin et al. | 169/37 |
| 669,421 | 3/1901 | Luce . | |
| 2,023,848 | 12/1935 | Loewenstein . | |
| 2,213,527 | 9/1940 | Lowe . | |
| 2,327,528 | 8/1943 | Kendall et al. . | |
| 2,389,333 | 11/1945 | Tyden . | |
| 2,531,790 | 11/1950 | Rowley | 169/38 |
| 2,558,450 | 6/1951 | Martin . | |
| 2,871,952 | 2/1959 | Doak . | |
| 3,107,732 | 10/1963 | Bakos . | |
| 3,195,647 | 7/1965 | Campbell et al. . | |
| 3,216,506 | 11/1965 | Bakos . | |
| 3,389,884 | 6/1968 | Ault | 248/345 |
| 3,525,402 | 8/1970 | Hattori . | |
| 3,633,676 | 1/1972 | Gloeckler . | |
| 3,714,989 | 2/1973 | Gloeckler . | |
| 3,727,695 | 4/1973 | Danton | 239/288.5 X |
| 3,756,321 | 9/1973 | Gloeckler . | |
| 3,783,947 | 1/1974 | Dix et al. | 169/40 |
| 3,815,821 | 6/1974 | Metcalfe | 248/345 X |
| 3,826,313 | 7/1974 | Yao . | |
| 4,014,388 | 3/1977 | Anderson . | |
| 4,015,665 | 4/1977 | Simons et al. . | |

(List continued on next page.)

FOREIGN PATENT DOCUMENTS 2155328A 9/1985 United Kingdom .

OTHER PUBLICATIONS

Central Sprinkler Corporation Bulletin A-RF Rev. No. 5, "Royal Flush" TM Concealed Automatic Sprinkler Model A.

Central Sprinkler Corporation Bulletin DP-K Royal Flush Rev. No. 5, "Royal Flush" TM Concealed Field Adjustable Dry Pendent Automatic Sprinkler Model A-1.

Central Sprinkler Corporation Bulletin RFS-76A Rev. No. 7, Adjustable Royal Flush Concealed Sprinkler Model "76A".

Central Sprinkler Corporation catalog sheet C-1A 4-87, Omega C-1A Residential Quick Response Commercial Standard Commercial Automatic Sprinkler.

Central Sprinkler Corporation catalog sheet C-1A ⅜ 8-87, Omega C-1A ⅜ Quick Response Standard Commercial Automatic Sprinkler.

Central Sprinkler Corporation catalog sheet EC-20A 4-87, Omega EC-20A Residential Extended Coverage Commercial Automatic Sprinkler.

Central Sprinkler Corporation catalog sheet FC 5-87, Flow Control-FC On-Off Automatic Sprinkler.

Central Sprinkler Corporation catalog sheet R-1 4-87, Omega R-1 Residential Pendent Automatic Sprinkler.

*Primary Examiner*—Joseph F. Peters, Jr.
*Assistant Examiner*—James M. Kannofsky
*Attorney, Agent, or Firm*—Panitch Schwarze Jacobs & Nadel

[57] ABSTRACT

A pendent style sprinkler includes a sprinkler body portion and a plug valve assembly having a sleeve secured to a deflector plate on an outlet side of the sprinkler body portion. A clip is wedged between the sprinkler body portion and the deflector plate. The clip includes a peripheral edge or tab portion projecting radially outwardly beyond a peripheral portion of the sprinkler body portion and a peripheral portion of the deflector plate. A ceiling cover is provided having a central portion adapted to contact the clip peripheral edge portion such that the cover is suspended at the central portion on the peripheral edge portion of the clip.

20 Claims, 3 Drawing Sheets

U.S. PATENT DOCUMENTS

| | | | |
|---|---|---|---|
| 4,019,582 | 4/1977 | Gangell | 169/37 |
| 4,066,129 | 1/1978 | Anderson . | |
| 4,105,076 | 8/1978 | Simons et al. . | |
| 4,117,887 | 10/1978 | Anderson | 169/37 |
| 4,139,062 | 2/1979 | Rago . | |
| 4,194,569 | 3/1980 | Heath . | |
| 4,214,631 | 7/1980 | Hattori . | |
| 4,215,751 | 8/1980 | Mears | 248/345 X |
| 4,217,960 | 8/1980 | Miyazaki . | |
| 4,228,859 | 10/1980 | Hattori . | |
| 4,366,866 | 1/1983 | Sweeney | 169/37 |
| 4,465,141 | 8/1984 | Johnson . | |
| 4,491,182 | 1/1985 | Pieczykolan . | |
| 4,508,175 | 4/1985 | Pieczykolan . | |
| 4,553,602 | 11/1985 | Pieczykolan . | |
| 4,596,289 | 6/1986 | Johnson . | |
| 4,618,001 | 10/1986 | Hoening . | |
| 4,618,002 | 10/1986 | Mears . | |
| 4,630,682 | 12/1986 | Pieczykolan . | |
| 4,660,648 | 4/1987 | Zen . | |
| 4,662,455 | 5/1987 | Simons | 169/37 |
| 4,664,198 | 5/1987 | Johnson . | |
| 4,766,961 | 8/1988 | Macie . | |

PENDENT STYLE SPRINKLER WITH COVER

FIELD OF THE INVENTION

The invention relates to pendent style sprinklers, i.e., sprinklers which extend downwardly through and discharge water downwardly from a ceiling and, in particular, such sprinklers with decorative covers.

BACKGROUND OF THE INVENTION

U S. Pat. No. 4,491,182 discloses a pendent style automatic sprinkler with escutcheon. The escutcheon slips over a smooth, sheet metal housing surrounding the body of the sprinkler.

Pendent style sprinklers are typically installed extending downwardly into or through a ceiling from piping running above the ceiling. The piping supplies water or other fire-retarding fluid to the sprinkler.

Pendant style sprinklers, like that disclosed in U.S. Pat. No. 4,491,182, are often installed in locations where aesthetics are a consideration, such as office buildings, schools, etc. To improve the appearance of such sprinkler installations, covers are preferred which hide the sprinkler and the ceiling opening while the sprinkler is not operating. During a fire, the cover must drop away from the sprinkler, at least by the time the sprinkler activates or "opens", so as not to interfere with the delivery of the water or other fire-retarding fluid through the sprinkler.

One approach which has been widely used for securing a cover to a sprinkler body so that the cover will disconnect from the sprinkler body during the fire, has been to use fusible connectors between the cover and a support member engageable with the sprinkler body. This approach is shown, for example, in U.S. Pat. Nos. 3,393,746, 3,727,695, 4,066,129 and 4,215,751 (FIG. 4). The device disclosed in U.S. Pat. No. 3,393,746 further provides a range of adjustability of the height of the cover on the sprinkler. In each case, the sprinkler and support member are provided with special structures to enable them to engage with one another. The covers cannot be used with sprinklers lacking the special structures to receive the cover support members.

U.S. Pat. No. 3,998,273 discloses a variation on this approach. A fusible connector is used to hold a magnet in place. The cover is coupled to the sprinkler by the magnet. The magnet permits the cover to be mounted to a generally featureless, ferrous housing. However, the height of the cover on the sprinkler is not adjustable and the magnet cannot be used with a non-ferrous housing.

A disadvantage of all of the aforesaid existing systems which use fusible connectors is that the systems must be designed to melt the fusible connector before melting the fusible element which triggers the sprinkler. This delays the response time of the sprinkler.

One advantage of the present invention is that it avoids the use of fusible connectors. This enables the invention to be used with fast responding sprinklers.

Another advantage of the present invention is that it permits the attachment of a cover to a pendent style sprinkler lacking special structures for receiving cover support members.

Other advantages of the invention are that its components are simple, relatively easy to manufacture, relatively easy to retro-fit on the style of pendent sprinkler shown in U.S. Pat. No. 4,491,182, and provide a cover which is adjustable in height with respect to the sprinkler and fully releasable upon opening or activation of the sprinkler.

SUMMARY OF THE INVENTION

One aspect of the invention relates to a pendent style sprinkler which comprises a sprinkler body portion having an outlet side for discharging a fire quenching fluid. The sprinkler further comprises a plug valve movable with respect to said sprinkler body portion for opening said sprinkler when said sprinkler is heated, a portion of said plug valve extending from said outlet side of said sprinkler body portion when said sprinkler body is closed. The sprinkler further comprises a clip resiliently wedged between said sprinkler body portion and said portion of said plug valve so as to separate from said sprinkler body portion and said plug valve when said plug valve moves to open said pendent sprinkler. A cover is provided having a central portion contacting a peripheral edge portion of said clip such that said cover is suspended from said peripheral edge portion of said clip.

In another aspect, the invention relates to a pendent style sprinkler having a sprinkler body portion including an outlet side and a plug valve assembly including a sleeve secured to a deflector plate on said outlet side. The sprinkler comprises a clip wedged between said sprinkler body portion and said deflector plate, said clip having a peripheral edge portion. The sprinkler further comprises a ceiling cover having a central portion adapted to contact said clip peripheral edge portion such that said cover is suspended on said peripheral edge portion.

In another aspect, the invention is a kit for use with a pendent style sprinkler having a sprinkler body portion with an outlet side and a plug valve assembly including a sleeve secured to a deflector plate on said outlet side of said sprinkler body portion. The kit comprises a clip adapted to be wedged resiliently between said sprinkler body portion and said deflector plate, the clip including a peripheral edge portion, and a ceiling cover having a central portion adapted to at least partially surround the sprinkler body portion and receive and contact said clip peripheral edge portion whereby said ceiling cover is supported from said peripheral edge portion of said clip.

BRIEF DESCRIPTION OF THE DRAWINGS

The foregoing Summary, as well as the following Detailed Description of the Invention, will be better understood when read in conjunction with the appended drawings. It should be understood, however, that this invention is not limited to the precise arrangements illustrated. In the drawings.

DETAILED DESCRIPTION OF THE INVENTION

The same reference numbers are used in the various figures to identify the identical elements.

Figure 1:
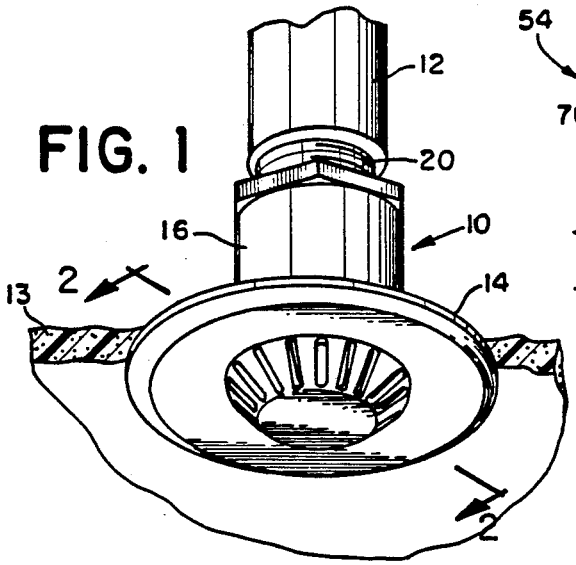
FIG. 1 is a bottom perspective view of a pendent style sprinkler mounting a cover of the invention.

Referring first to FIG. 1, a pendent style sprinkler, indicated generally at 10, extends downwardly from a pipe 12 through a ceiling 13. A cover 14 is suspended from the sprinkler 10 in a manner to be described. A body portion of the sprinkler 10, indicated generally at 16, is also visible in FIG. 1.

Figure 2:
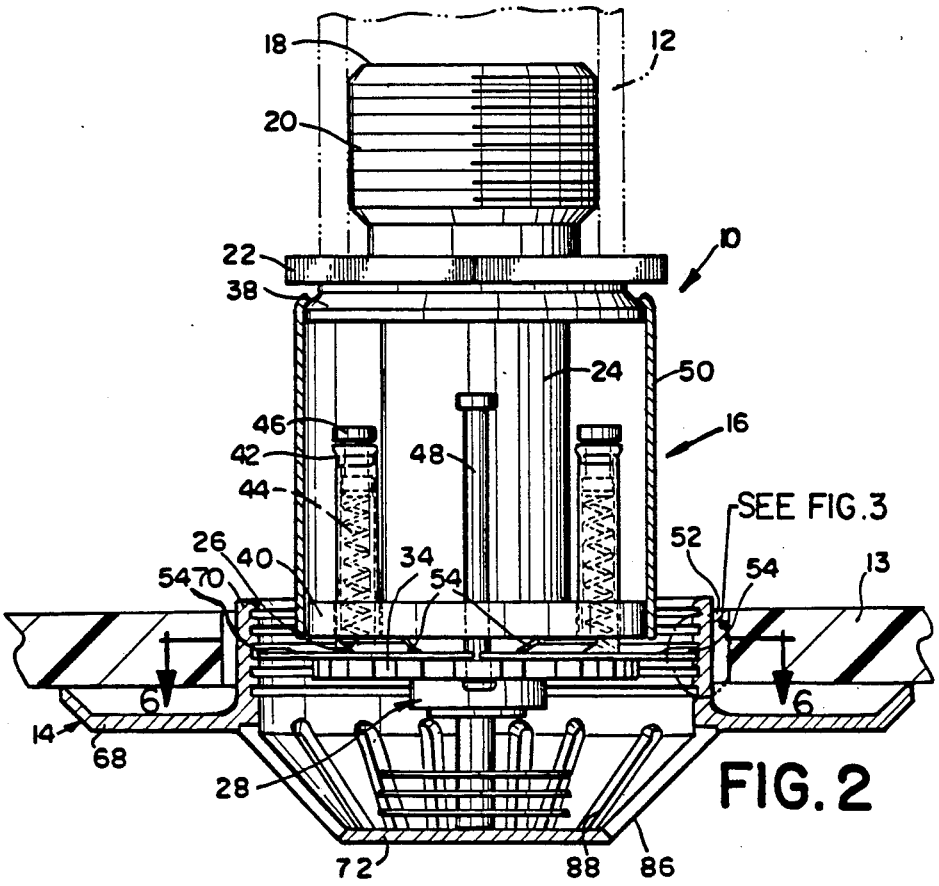
FIG. 2 is a partially sectioned, side elevation view of the device taken along the lines 2—2 of FIG. 1.

Sprinkler 10 may be a conventional pendent style automatic sprinkler like that described, for example, in U.S. Pat. No. 4,491,182, which is incorporated by reference herein in its entirety. Referring to FIG. 2, the sprinkler body portion 16 includes an inlet side 18 including a threaded coupling portion 20 threadingly received in the pipe 12. A nut portion 22 of the sprinkler body portion 16 permits the sprinkler body portion 16 to be tightened into the pipe 12 with a wrench. The sprinkler body portion 16 further includes a hollow valve body portion 24 which couples the inlet side 18 with an outlet side 26 (bottom of FIG. 2) of the sprinkler body portion 16. A plug valve assembly, indicated generally at 28, is partially received in the outlet side 26 of the sprinkler body portion 16 before the sprinkler 10 is activated or "opened" by heating. When heated sufficiently, the plug valve assembly 26 moves outwardly from the sprinkler body portion 16, on the outlet side 26, to a position indicated in FIG. 4, so as to activate or "open" the sprinkler 10.

Figure 4:
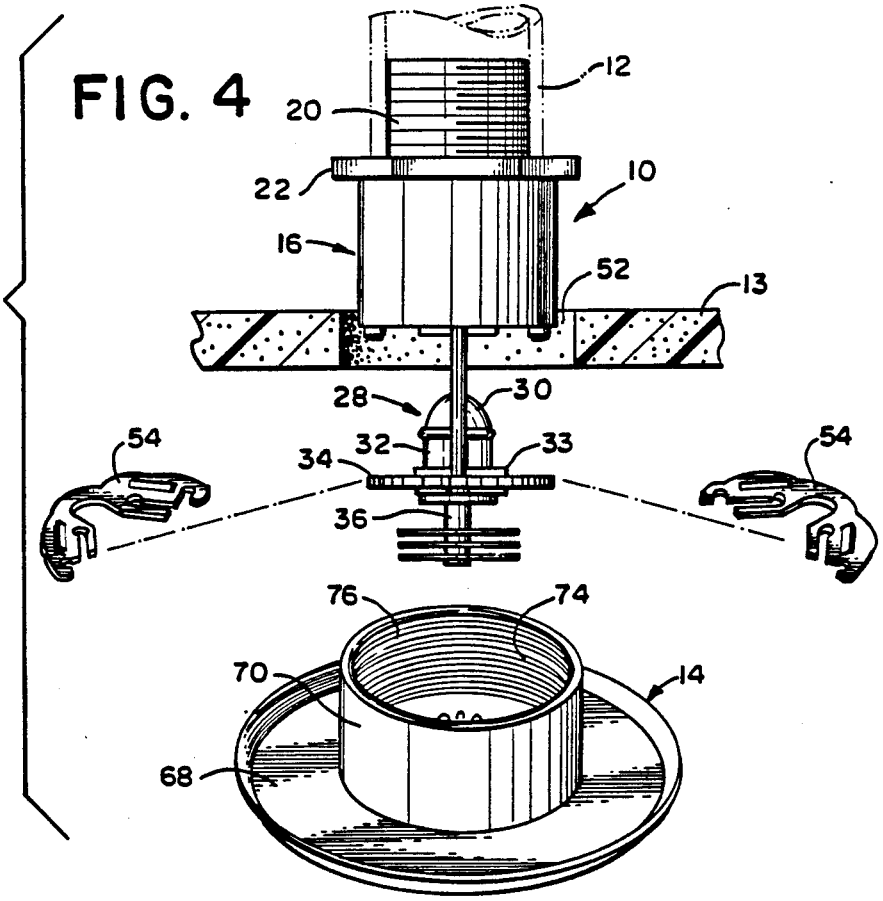
FIG. 4 is a side elevation view of the device of FIG. 1 in an activated or open configuration.

Referring to FIG. 4, the plug valve assembly 28 includes a plug valve 30 received in the sprinkler body portion 16, a sleeve 32 secured to a deflector plate 34 for coupling the deflector plate 34 with the plug valve 30, and a thermal transfer means in the form of a thermal transfer assembly 36 projecting outwardly (downwardly in the figures) away from the deflector plate 34 and sprinkler body portion 16.

Referring to FIG. 2, the sprinkler body portion 16 further includes a generally conical flange 38 formed on an outlet side of the nut portion 22 and a generally cylindrical flange 40 formed at the outlet side 26 of the sprinkler body portion 16. The cylindrical flange 40 supports a pair of diametrically opposed tubes 42 each containing a compression coil spring 44. In the "closed" configuration of the sprinkler 10, as shown in FIG. 2, the coil springs 44 are compressed against the deflector plate 34 adjoining the outlet side 26 of the sprinkler body portion 16 by a retainer 46 secured by crimping at an end of each tube 42 distal to the deflector plate 34. The cylindrical flange 40 further supports identical, diametrically opposed retainer pins only one of which (48) is indicated only in FIG. 6. The retainer pin 48 extends through an associated opening in the cylindrical flange 40 and the deflector plate 34. The retainer pin 48 is flanged at its opposing axial ends to prevent passage of the axial ends through either the deflector plate 34 or the cylindrical flange 40. A cylindrical sheet metal housing 50 extends between the conical flange 38 and cylindrical flange 40 and is secured by crimping to the conical flange 38. The housing 50 covers and protects the tubes 42 and retainer pins 48.

Referring to the various FIGS. 1, 2 and 4, the threaded coupling portion 20 at the inlet end 18 of the sprinkler body portion 16 is threadedly coupled with the pipe 12 above an opening 52 through the ceiling 13. Referring particularly to FIG. 2, in the "closed" or unactivated configuration of the sprinkler 10, the deflector plate 34 adjoins the cylindrical flange 40 of the sprinkler body portion 16, with the thermal transfer assembly 36 extending downwardly through the ceiling opening 52. When the thermal transfer assembly 36 is heated sufficiently, the plug valve assembly 28 is released and drops on the retainer pins 48 to the extended or deployed position indicated in FIG. 4 in which the sprinkler 10 is "opened" or activated. In this position, pressurized water or other fire retarding fluid passes from the pipe 12 through the sprinkler body portion 16 dropping onto the plug 30 and deflector plate 34 which spray the water or other fluid in a radial pattern down and around the plug valve assembly 28. Further details regarding the construction and operation of the sprinkler body portion 16 and plug valve assembly 28 are provided in the aforesaid U.S. Pat. Ser. No. 4,491,182.

Referring again to FIG. 2, clip means in the form of at least one and, preferably, a pair of substantially identical clips 54 are wedged resiliently in diametrically opposed sides of the sprinkler 10 in a generally annular recess formed between the cylindrical flange 40 of the sprinkler body portion 16 and the deflector plate 34 of the plug valve assembly 28 when the sprinkler 10 is in the "closed" or unactivated configuration with the deflector plate 34 immediately adjoining the cylindrical flange 40.

Figure 5:
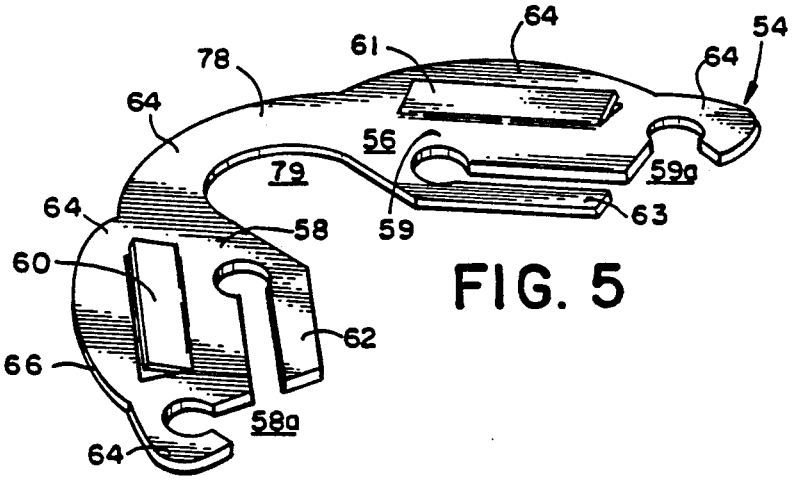
FIG. 5 is a perspective view of a first clip embodiment.

A first embodiment of clip 54 is shown in detail in FIG. 5. The clip 54 preferably includes a generally planar, semi-annular body 56 comprising a pair of substantially mirror-image arms 58 and 59. The arms 58 and 59 are connected by a bridge portion 78 of the body 56. The bridge portion 78 is formed by a cutout 79 through which one of the springs 44 of the sprinkler body portion 16 extends (see FIGS. 2 and 6). If the arms 58 and 59 are sufficiently long, cutouts 58*a* and 59*a* are preferably provided at the remote ends to avoid contacting the retainer pins 48 (see FIG. 6). Each arm 58 and 59 preferably is provided with a resiliently deflectable wedge means 60 and 61, respectively, extending generally transversely from the plane of the clip body 56, preferably at about a 45° angle, for wedging and retaining the clip 54 between the deflector plate 34 and the cylindrical flange 40. Preferably, the wedge means 60 and 61 are formed from tab portions cut and bent from the arms 58 and 59.

Each of the arms 58 and 59 further preferably includes a resiliently deflectable finger 62 and 63, respectively, on an "inner" peripheral side of the clip. The fingers 62 and 63 facilitate locating the clip 54 with respect to the sleeve 32 of the plug valve assembly 28, as is shown most clearly in FIG. 6. Each clip 54 further includes a scalloped "outer" peripheral edge 66 having at least one and preferably a plurality of peripheral edge or "tab" portions 64 in the form of the projecting portions of the scalloped edge, preferably extending radially outwardly in the plane of the clip body 56. Each tab portion 64 is sized or positioned to project radially beyond the peripheral surface of the housing 50 when the locating fingers 62, 63 are in contact with sleeve 32, in particular, a flange portion 33 of sleeve 32, and undeflected, as indicated in FIG. 6.

Figure 3:
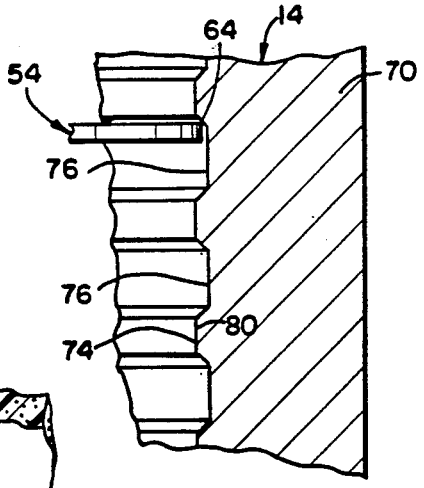
FIG. 3 is an expanded, side elevation view of the indicated portion of FIG. 2.

Referring to FIG. 2, the ceiling cover 14 includes a generally annular flange portion 68 and a central portion indicated generally at 70. The latter extends generally axially from one side of the annular portion 68 upwardly through the opening 52 and is coaxial with the annular portion 68. A conical slotted portion 72, generally coaxial with the annular and central portions 68 and 70, extends generally axially from a side of the annular portion 68 opposite the central portion 70. Referring to FIG. 3, the central portion 70 is generally cylindrical and includes an inside surface 74 provided with a plurality of generally parallel, spaced annular grooves 76 which define generally parallel, spaced annular ribs 80.

Figure 6:
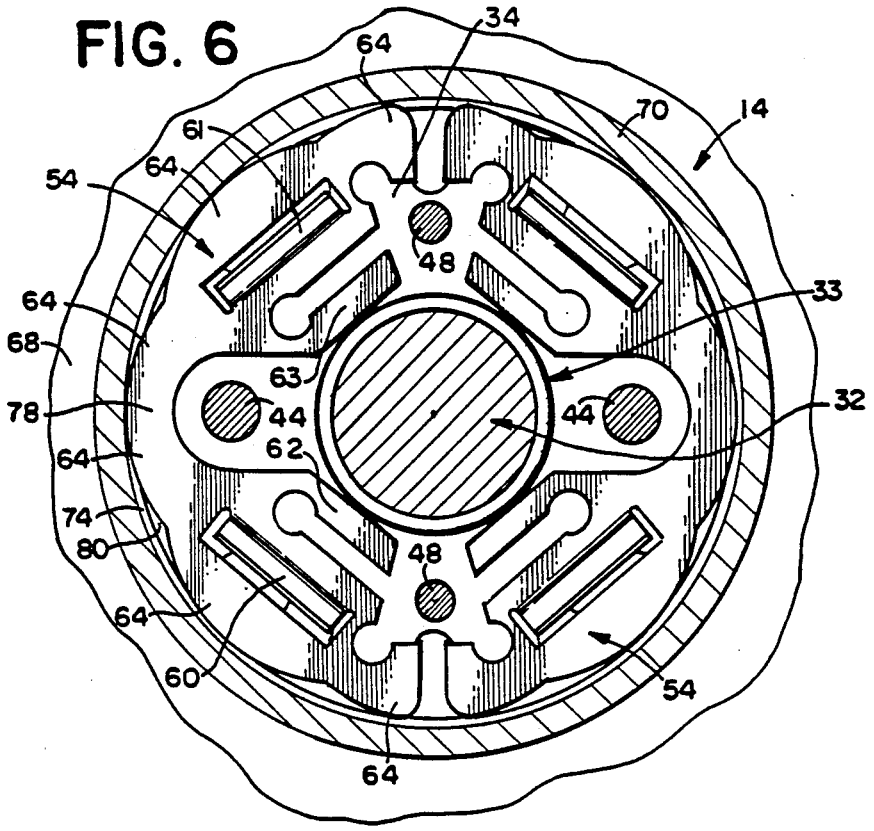
FIG. 6 is a top plan section view taken along the lines 6—6 of FIG. 2.

Referring to FIG. 6, the deflectable fingers 62 and 63 and the bridge portion 78 of the clip body 56 joining the arms 58 permit the clip 54 to be cammed inwardly towards the axial center of the sprinkler body portion 16, between the cylindrical flange portion 40 and the deflector plate 34, when the tab portions 64 of the clip 54 are contacted by ribs 80 (see FIG. 3) of the internal surface 74. Ribs 80 are appropriately sized to cam the clips 54 inwardly when cover 14 is pushed up or pulled down to attach, remove or adjust the height of the cover on the sprinkler body portion 16. When the peripheral edge portions or tabs 64 are opposite a groove 76 between adjoining ribs 80, the fingers 62 and 63 are unloaded and reassume their undeflected configuration contacting the flange portion 33 of sleeve 32 and biasing the tab portions 64 into the groove 76. Thus, when the cover 14 is located at about the desired height, the tab portions 64 will seat in a groove 76 between adjacent ribs 80 so that the cover 14 is suspended on the tab portions 64 of the clips 54.

Referring to FIG. 2, the conical slotted portion 72 of the cover 14 includes a conical surface 86 and a plurality of angularly spaced slots 88 extending therethrough. Each of the conical portion 72 and the conical surface 86 generally encompasses the thermal transfer assembly 36. Preferably, the slots 88 are uniformly sized and spaced around the conical surface 86. It is preferred that the conical portion 72 has an axial height (i.e. extends axially from the annular portion 68) of at least about ¼ inch or more and that the plurality of slots 88 cover about 45 percent or more of the conical surface 86 to permit adequate passage of heated gas through the cover 14 to the thermal transfer assembly 36. It has been found that such dimensional considerations enable the cover 14 to be used with a quick responding sprinkler of the type disclosed in the previously identified U.S. Pat. No. 4,491,182. If covered by cover 14 of the present invention, that sprinkler will activate within about ten seconds when exposed to a predetermined minimum temperature of about 160° F., as opposed to 60 to 80 seconds for other types of prior, covered, pendent style sprinklers.

The wedge means 60, 61 and the fingers 62, 63 of the clip 54 provide a degree of spring biasing to the clip 54 in two dimensions. Wedge means 60 and 61 bias the clip generally perpendicularly to the plane of the clip body 56. Fingers 62 bias the clip 54 in the plane of the clip body 56. This biasing is sufficient to force the clip 54 radially outwardly from the sprinkler for interfering engagement of tab portions 64 with the ribs 80 of the central portion 70 of the ceiling cover 14. This assures positive latching of the ceiling cover on the clips 54.

Figure 7:
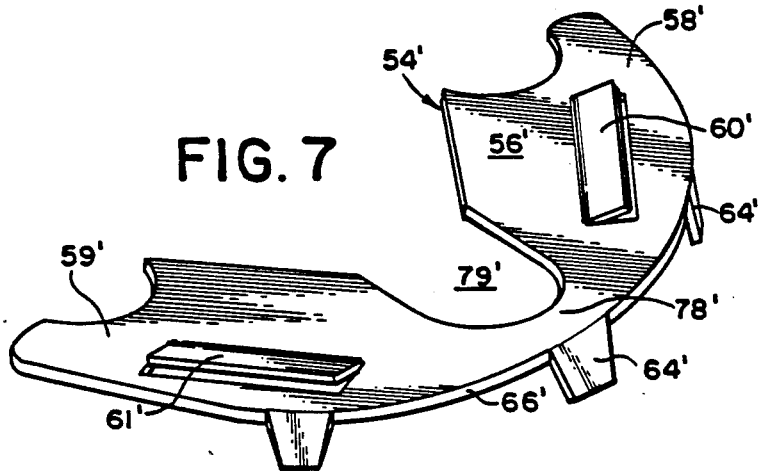
FIG. 7 is a perspective view of a second clip embodiment.

A second clip embodiment 54' is shown in FIG. 7. The clip 54' preferably includes a generally semiannular, generally planar body 56' having a central cutout 79' defining a bridge portion 78' for extending around a coil spring 44 and connecting a pair of substantially mirror-image arms 58' and 59'. Again, cutouts **58*a'* and 59*a'* preferably are provided at the remote ends of the arms 58' and 59' to avoid contacting the retainer pins 48. Each arm 58' and 59' preferably is provided with a resiliently deflectable wedge means 60' and 61', respectively, extending generally transversely from the plane of the body 56', preferably at about a 45° angle, for wedging the clip 54' between the deflector plate 34 and the cylindrical flange 40. Projecting transversely from the plane of the body 56', preferably in a direction opposite the wedge means 60' and 61' and slightly outwardly from a generally circular outer edge 66' of the body 56', are a plurality of peripheral edge or tab portions in the form of individual, deflectable lugs 64'. Preferably, the clip 54' is installed with the deflectable lugs 64' extending upwardly, i.e., towards the sprinkler body portion 16. The lugs 64' are deflected radially inwardly, towards the axial center of the sprinkler body portion 16, when contacted by the ribs 80 of the internal surface 74 of the cover 14 as the central portion 70 is pushed upwardly or towards the inlet side 18 of the sprinkler body portion 16. Again, the lugs 64' seat in the grooves or spaces 76 between ribs 80 such that the cover 14 is suspended on the lugs 64' by interfering engagement between the lugs 64' and the ribs 80**.

Preferably, the clips 54 and 54' are made from a corrosion-resistant material, such as stainless steel or a beryllium-copper alloy, and by die stamping. The ceiling cover 14 may be formed from a thermoplastic material by molding or the like. A thermoplastic material eliminates any cold sinking of heat, should the thermal transfer assembly 36 be contacted by the cover 14.

Installation and use of the pendent style sprinkler 10 is disclosed in the previously identified and incorporated U.S. Pat. No. 4,491,182. The cover 14 of the present invention is installed by inserting at least one (and preferably a pair) of clips 54 or 54' (the pair being inserted on opposite sides of the sprinkler) between the deflector plate 34 and the cylindrical flange 40 so that the tab portions 64 or 64' of the clip(s) extend radially outwardly beyond the periphery of the deflector plate 34 and sheet metal housing 50. The central portion 70 of the cover 14 is installed over the outlet side 24 of the sprinkler body portion 16 and pushed upwardly (towards the inlet side), deflecting the clip fingers 62, 63 or lugs 64' radially inwardly. The central portion 70 of the cover 14 slips over the tab portions 64 or 64' of the clip(s) 54 or 54' until the cover 14 is located at the desired height whereupon the cover 14 is released. The clip fingers 62, 63 spring radially outwardly to cause the clip tab portions 64 to lodge between adjacent ribs 80 (or the lugs 64' themselves spring radially outwardly lodging between adjacent ribs 80) thereby supporting the cover 14.

One of ordinary skill in the art will appreciate that the particular pendent style sprinkler disclosed in U.S. Pat. No. 4,491,182 can be used with the cover of the present invention, simply by installing the clips 54, 54' and a cover 14 in the manner previously described. Accordingly, the cover and at least one of the clips of the present invention together constitute a kit for use with such sprinklers.

While a quick-reacting, pendent style sprinkler with a ceiling cover and various clip embodiments have been described, one of ordinary skill in the art will appreciate that the present invention may be embodied in other specific forms without departing from the spirit or central attributes thereof. Accordingly, reference should be made to the appended claims, rather than to the foregoing specification, as indicating the scope of the invention.

I claim:

1. Pendent style sprinkler having a sprinkler body portion including an outlet side and a plug valve assembly including a sleeve secured to a deflector plate on said outlet side, comprising: a clip wedged between said sprinkler body portion and said deflector plate, said clip having a peripheral edge portion, and a ceiling cover having a central portion adapted to contact said clip peripheral edge portion such that said cover is suspended on said clip peripheral edge portion.

2. Pendent style sprinkler according to claim 1 wherein said cover is provided with an annular flange portion extending generally radially outwardly of said central portion, and a conical, slotted portion extending away from a side of said annular flange portion generally opposite said central portion.

3. Pendent style sprinkler according to claim 2 further comprising a thermal transfer means projecting outwardly from said deflector plate for opening said pendent sprinkler when heated, and said cover conical portion generally encompassing said thermal transfer means and having a plurality of open slots extending therethrough.

4. Pendent style sprinkler according to claim 3 wherein said plurality of slots covers about 45% or more of the surface of said conical portion and wherein said conical portion has an axial height of about ¼ inch or more.

5. Pendent style sprinkler according to claim 1 wherein said clip has at least one resiliently deflectable wedge means for wedging and retaining said clip between said sprinkler body portion and said deflector plate.

6. Pendent style sprinkler according to claim 1 wherein said clip includes a pair of arms, each arm being provided with a resiliently deflectable finger for locating said clip with respect to said sleeve.

7. Pendent style sprinkler according to claim 1 wherein said cover central portion is generally cylindrical and is provided with an internal surface having a plurality of spaced ribs, said cover and said clip being dimensioned such that said clip peripheral edge portion seats between adjoining ribs.

8. Pendent style sprinkler according to claim 7 wherein at least a portion of said clip resiliently deflects when said clip peripheral edge portion is contacted by portions of said internal surface thereby facilitating slip fitting of said central portion of said cover over said deflector plate.

9. Pendent style sprinkler comprising:

a sprinkler body portion including an outlet side for discharging a fire quenching fluid;

a plug valve movable with respect to said sprinkler body portion for opening said sprinkler when said sprinkler is heated, a portion of said plug valve extending from said outlet side of said sprinkler body portion when said sprinkler is closed;

a clip wedged between said sprinkler body portion and said portion of said plug valve so as to separate from said sprinkler body portion and said plug valve portion when said plug valve moves to open said sprinkler; and a cover having a central portion contacting a peripheral edge portion of said clip such that said cover is suspended from said peripheral edge portion of said clip.

10. Pendent style sprinkler according to claim 9 wherein said clip is resiliently wedged between said sprinkler body portion and said portion of said plug valve.

11. Pendent style sprinkler according to claim 9 wherein said cover includes a portion extending across one end of said central portion and concealing said portion of said plug valve extending from said outlet side.

12. Pendent style sprinkler according to claim 11 wherein said portion of said cover is slotted.

13. Pendent style sprinkler according to claim 12 wherein said portion of said cover is generally conical and wherein said conical portion has an axial height of about one-quarter inch or more.

14. Pendent style sprinkler according to claim 13 further comprising thermal transfer means projecting outwardly from said plug valve towards said conical portion of said cover for opening said sprinkler when heated.

15. Pendent style sprinkler according to claim 14 wherein said conical portion is slotted and said slots cover about 45% or more of the surface of said conical portion.

16. Pendent style sprinkler according to claim 11 further comprising thermal transfer means projecting outwardly from said plug valve towards said cover for opening said sprinkler when heated.

17. Pendent style sprinkler according to claim 9 wherein said portion of said plug valve extending from said outlet side of said sprinkler body includes deflector means for deflecting fire quenching fluid radially outwardly from the sprinkler when said sprinkler is opened and wherein said clip is wedged between said sprinkler body portion and said deflector means portion of said plug valve.

18. Pendent style sprinkler according to claim 17 further comprising retainer means coupled with said sprinkler body and said deflector means for supporting said deflector means at an extended position spaced away from the sprinkler body when the sprinkler is opened.

19. Pendent style sprinkler according to claim 17 wherein said cover includes a portion extending across one end of said central portion and covering said deflector means.

20. Pendent style sprinkler according to claim 10 wherein at least a portion of said clip resiliently deflects when said clip peripheral edge portion is contacted by portions of said central portion thereby facilitating slip fitting of said cover onto said clip.

* * * * *